US007326319B2

(12) United States Patent
Lares et al.

(10) Patent No.: US 7,326,319 B2
(45) Date of Patent: Feb. 5, 2008

(54) METHOD OF PRE-CALENDERING A BOARD WEB

(75) Inventors: Matti Lares, Tuusula (FI); Mikko Tani, Appleton, WI (US)

(73) Assignee: Metso Paper, Inc., Helsinki (FI)

( * ) Notice: Subject to any disclaimer, the term of this patent is extended or adjusted under 35 U.S.C. 154(b) by 463 days.

(21) Appl. No.: 10/497,344

(22) PCT Filed: Nov. 15, 2002

(86) PCT No.: PCT/FI02/00907

§ 371 (c)(1),
(2), (4) Date: Nov. 22, 2004

(87) PCT Pub. No.: WO01/83883

PCT Pub. Date: Nov. 8, 2001

(65) Prior Publication Data

US 2005/0077651 A1 Apr. 14, 2005

(30) Foreign Application Priority Data

Dec. 12, 2001 (FI) ..... 20012445

(51) Int. Cl.
*D21G 1/00* (2006.01)
*B29C 43/24* (2006.01)

(52) U.S. Cl. ..... 162/205; 162/206; 162/207; 100/38; 427/444

(58) Field of Classification Search ..... 162/204–207, 162/358.1, 358.3, 358.5, 361; 100/38, 153, 100/156, 160; 118/73; 427/444
See application file for complete search history.

(56) References Cited

U.S. PATENT DOCUMENTS

| | | | | |
|---|---|---|---|---|
| 5,137,678 | A | 8/1992 | Hess et al. | |
| 6,190,500 | B1 * | 2/2001 | Mohan et al. | 162/134 |
| 6,287,424 | B1 | 9/2001 | Mohan et al. | |
| 6,485,611 | B2 * | 11/2002 | Bauer | 162/205 |
| 6,497,790 | B2 * | 12/2002 | Mohan et al. | 162/206 |
| 2002/0060022 | A1 | 5/2002 | Bauer | |
| 2003/0150581 | A1 | 8/2003 | Lares et al. | |

FOREIGN PATENT DOCUMENTS

| | | | |
|---|---|---|---|
| DE | 19545408 | A | 6/1997 |
| FI | 107814 | B | 10/2001 |
| WO | WO 99/67462 | * | 12/1999 |
| WO | WO 01/83883 | A1 | 11/2001 |
| WO | WO 01/98585 | A1 | 12/2001 |

* cited by examiner

*Primary Examiner*—Eric Hug
(74) *Attorney, Agent, or Firm*—Alston & Bird LLP

(57) ABSTRACT

A method for pre-calendering a board web is provided and comprises passing the board web in a pre-calendering process through at least one hard nip, formed by a metal roll and a counter roll, and through at least one long nip, formed by a thermo roll and a long-nip roll or a long-nip belt assembly. The surface of the board web is moistened with water prior to the board web passing through the at least one hard nip.

3 Claims, 1 Drawing Sheet

METHOD OF PRE-CALENDERING A BOARD WEB

CROSS-REFERENCE TO RELATED APPLICATIONS

Figure 1:
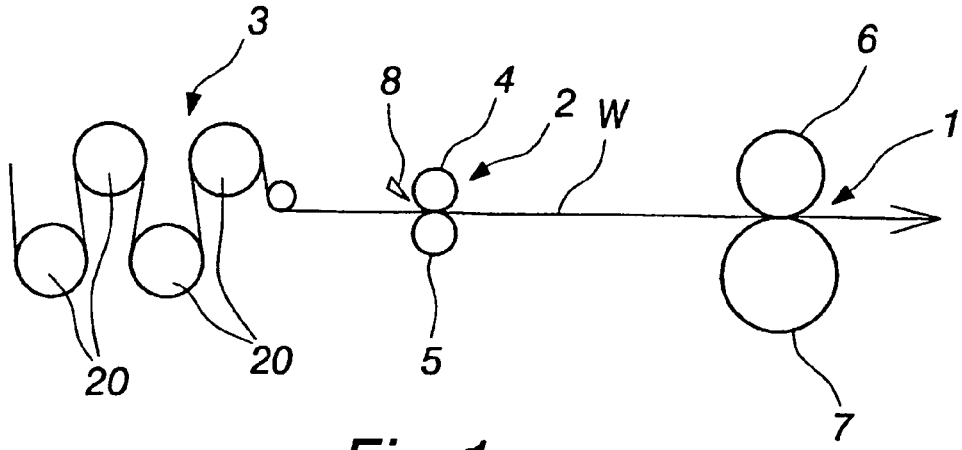

This application is a U.S. National Phase application of PCT/FI02/00907; filed Nov. 15, 2002, and claims priority to Finnish Application No. 20012445; filed Dec. 12, 2001, which are incorporated herein in their entirety by reference.

BACKGROUND OF THE INVENTION

1. Field of the Invention

The present invention relates to a method for pre-calendering a board web.

2. Description of Related Art

It is an object of the invention to provide an improved pre-calendering method for board, which is particularly applicable to coated boards, such as SBS (Solid Bleached Sulfate Board). The SBS comprises a bottom layer, a filler layer, a top layer, all made of pulp, and a coating. It is prior known to upgrade surface quality without compromising structural features of the board, by subjecting the board surface to water moistening. Moreover, it has been discovered that long-nip calendering is applicable as a pre-calendering method for coated boards, but that cannot be used for the thickness profiling of a web as required by a coating process.

BRIEF SUMMARY OF THE INVENTION

In order to provide an improved pre-calendering method for board, the inventive method is characterized in that said method comprises passing a board web in a pre-calendering process through at least one hard nip, which is formed by a metal roll and its counter roll, and through at least one long nip, which is formed by a thermo roll and a long-nip roll or a long-nip belt assembly, and said method comprising moistening the surface of the board web with water prior to passing the same through said at least one hard nip.

The inventive method comprises in combination: water moistening of a web surface, passing the web through a hard nip for its thickness profiling and then through a long-nip calendar for completing pre-calendering of the web prior to coating, for the best final result with certain types of board. In a method of the invention, the metal roll for a hard nip must be unheated in order to avoid heating of the web in the nip and, thus, not to lose moisture gradient.

Application of water to the surface of either or each roll of a hard nip, for example by means of a water box or the application bar of a film transfer coater, provides a relatively advantageous solution. In this embodiment, the web has a moisture content which is preferably about 1-2% upstream of the hard nip.

Moistening of the web can also be effected by using, for example, a water moistening apparatus manufactured by VIB Apparatebau GmbH of Germany, which is positioned preferably in a drying section between two drying cylinders, in which case the moisture content of a web upstream of the moistening apparatus can be higher, in the order of about 5-6%, than that of the embodiment in which the water is applied to the surface of a hard-nip roll. Another way of moistening a web is steaming.

In one alternative embodiment, said VIB water moistening apparatus can also be positioned in a space between a hard nip and a long nip, in which case the moisture content of a web may also be in the same category of 56% upstream of the moistening apparatus.

BRIEF DESCRIPTION OF THE SEVERAL VIEWS OF THE DRAWING(S)

Figure 2:
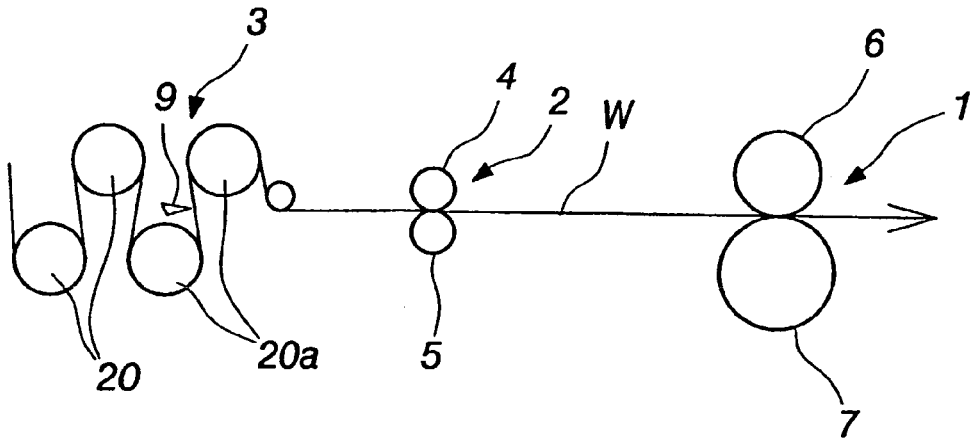
Figure 3:
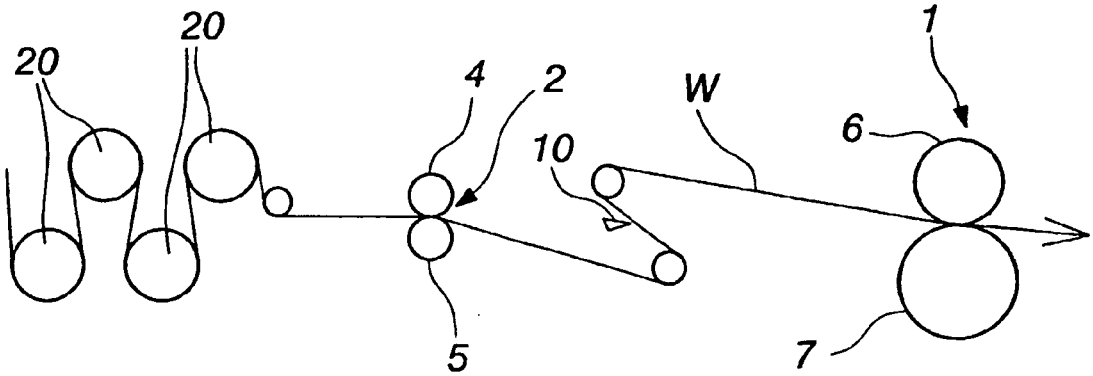

The invention will now be described with reference to the accompanying drawings, in which:

FIGS. 1-3 illustrate schematically optional pre-calendering configurations.

DETAILED DESCRIPTION OF THE INVENTION

Referring to the figures, reference numeral 1 is used to indicate a long nip, consisting of a thermo roll 6 and a long-nip roll, e.g. a shoe roll 7. The shoe roll 7 can also be replaced by a belt calendar assembly, comprising a normal thermo roll for soft calendar, a belt run, and a counter roll which can be either a hard or soft roll. Reference numeral 2 indicates a hard nip, which is formed by a metal roll 4, which is preferably a thermo roll, and by its counter roll 5. The downstream end of a drying section is shown with reference numeral 3 and comprises drying cylinders 20, just a few of which are shown.

In the embodiment of FIG. 1, a moistening device 8 for the surface of a board web is positioned to enable application of water to the surface of the metal roll 4 of the nip 2. The moistening device 8 can be constituted for example by a water box or the application bar of a film transfer coater. The water can also be applied to the surface of the counter roll 5 or to the surface of both rolls by an appropriate arrangement of the moistening device or devices. The web is dried in the drying section 3 to a moisture content of about 1-2%.

In the embodiment of FIG. 2, a moistening device 9 for the surface of a board web, which can be for example a VIB water moistening apparatus, is positioned in a drying section between two cylinders 20*a* and 20*a*, which are the final cylinders prior to the hard nip 2.

FIG. 3 illustrates one option, employing a moistening device 10 for the surface of a board web, which can be identical to the surface moistening device 9. The moistening device is located in a section extending between the hard nip 2 and the long nip 1.

In the embodiments of FIGS. 2 and 3, the web can have a moisture content within the range of 5-6% upstream of the moistening device 9 or 10, respectively.

The invention claimed is:

1. A method for pre-calendering a board web, comprising:

passing a board web in a pre-calendering process through at least one hard nip, formed by a metal roll and a counter roll, and through at least one long nip formed by a thermo roll and at least one of a long-nip roll and a long-nip belt assembly; and moistening a surface of the board web with water, prior to the board web passing through said at least one hard nip, using a surface moistening device positioned in a drying section preceding the pre-calendering process, the surface moistening device being disposed between two drying cylinders, and the board web having a moisture content of between about 5% and about 6% upstream of the surface moistening device.

2. A method as set forth in claim 1 wherein the surface moistening device comprises at least one of a water moistening apparatus and a steam moistening apparatus.

3. A method as set forth in claim 1, wherein the metal roll in the hard nip comprises a thermo roll.

* * * * *